US005389162A

United States Patent [19]

Endou et al.

[11] Patent Number: 5,389,162

[45] Date of Patent: Feb. 14, 1995

[54] METHOD FOR TREATING A METAL CAN SURFACE

[75] Inventors: Syunichi Endou; Masahiro Jo; Satoshi Miyamoto, all of Osaka, Japan

[73] Assignee: Nippon Paint Co., Ltd., Osaka, Japan

[21] Appl. No.: 161,088

[22] Filed: Dec. 3, 1993

Related U.S. Application Data

[62] Division of Ser. No. 40,436, Apr. 1, 1993, abandoned.

[30] Foreign Application Priority Data

Apr. 3, 1992 [JP] Japan ..... 4-082508

[51] Int. Cl.[6] ..... C23C 22/82

[52] U.S. Cl. ..... 148/257; 148/246; 148/253

[58] Field of Search ..... 106/243, 244; 426/602; 148/246, 253, 257; 252/49.3, 49.5, 52 R

[56] References Cited

U.S. PATENT DOCUMENTS

| | | | |
|---|---|---|---|
| 2,685,521 | 8/1954 | Edgar | 106/244 |
| 3,278,321 | 10/1966 | Hazdra | 106/243 |
| 3,782,970 | 1/1974 | Tomita et al. | 426/602 |
| 4,073,412 | 2/1978 | Doumani | 106/244 |
| 4,212,750 | 7/1980 | Gorman | 252/32.5 |
| 4,637,885 | 1/1987 | Kuwamoto et al. | 252/32.5 |
| 4,859,351 | 8/1989 | Awad | 252/52 R |
| 5,082,684 | 1/1992 | Fung | 426/602 |
| 5,217,742 | 6/1993 | Jones et al. | 426/602 |

FOREIGN PATENT DOCUMENTS

| | | | |
|---|---|---|---|
| 0293820 | 12/1988 | European Pat. Off. . | |
| 0346717 | 12/1989 | European Pat. Off. . | |
| 0508418 | 10/1992 | European Pat. Off. . | |
| 52-12207 | 4/1977 | Japan | 106/243 |
| 59-210971 | 11/1984 | Japan | 426/602 |
| 61-74541 | 4/1986 | Japan | 426/602 |
| 61-166372 | 7/1986 | Japan | 426/602 |
| 63-044936 | 2/1988 | Japan | 426/602 |
| 64-85292 | 3/1989 | Japan . | |
| WO81 03293 | 11/1981 | WIPO . | |

OTHER PUBLICATIONS

Database WPI, Section Ch, Week 8801, Derwent Publications Ltd., London, GB; Class A97, AN 88-004792 & JPA--62 270 443 (Yamamura Glass) Nov. 24, 1987 (abstract).

Database WPI, Section Ch, Week 8430, Derwent Publications Ltd., London, GB; Class A82, AN 84-185817 & JP-A-59 105 094 (Kishimoto A) Jun. 18, 1984, abstract.

*Primary Examiner*—Anthony Green

*Attorney, Agent, or Firm*—Armstrong, Westerman, Hattori, McLeland & Naughton

[57] ABSTRACT

The present invention provides a surface-treating agent for a metal can, which has an effect of elevating smoothness of the metal can, shows a low foaming property and high thermal stability, but not uneasiness at safety, and thereby contributes to elevate a transferring speed of a metal can body in producing the metal can. A surface-treating agent for a metal can, comprising an emulsion containing a sorbitan fatty acid ester in a concentration of 100 to 2000 mg/l in a water medium, is sprayed to a metal can body in the final stage of a rinsing process which is carried out after a converting process.

12 Claims, 2 Drawing Sheets

METHOD FOR TREATING A METAL CAN SURFACE

This application is a division of application Ser. No. 08/040,436, filed Apr. 1, 1993, abandoned.

BACKGROUND OF THE INVENTION

The present invention relates to a surface-treating agent, which is applied in the final stage of a rinsing process after formation of a phosphate film on a metal can body, diminishes a friction coefficient of interior and exterior surfaces of the metal can body, intends elevation of mobility of the can body, intends load decrease and smooth insertion of mandrel coming in and out in a coating process, and thereby prevents abrasion of the mandrel. Furthermore, the invention relates to a concentrate for treating a metal can surface, from which the surface-treating agent is prepared.

The present invention also relates to a method for treating a metal can surface, which is carried out in order to intend elevation of mobility of the can body and to intend load decrease and smooth insertion of a mandrel coming in and out in a coating process.

The metal can includes: a 2-piece type can consisting of a tube-like body part (which has a bottom) and a roof plate; and a 3-piece type can consisting of a tube-like body part (which does not have a bottom), a bottom plate, and a roof plate. A body part of these, that is, a metal can body is generally prepared by treating a metal plate in order by each process of molding, degreasing, rinsing, converting, rinsing, drying, and coating. In the processes of from molding to drying, many can bodies having been spread sideways are transferred at high speed in a wide line for treating. However, in the processes of drying and coating, the line width becomes narrow and thus, gathered can bodies are transferred one by one. In the coating process, the can bodies transferred one by one are in order printed or coated on the exterior surface.

The metal cans have been produced in large quantities as a food vessel for a refreshing drink, an alcoholic drink or the like and in recent years production of the metal cans has much increased in amount compared with other kinds of vessels. On the other hand, production of the refreshing drink, alcoholic drink and the like much varies in amount with seasons. It is general to cope with the increase and variation of the production amount of the metal cans by avoiding capital investment as much as possible in a view point of cost and by elevating production speed still more or varying it up and down. Varying the production speed up and down is very dependent upon the transferring speed of the metal cans.

As mentioned above, when the can bodies being transferred gather, they come into contact or collision with each other. Even if the can bodies being transferred at relatively slow speed come into contact or collision with each other, disadvantage to mobility does not occur.

However, if the can bodies being transferred at very fast speed come into contact or collision with each other, mobility becomes bad and their breakage or jumping out of a transfer device occurs.

Therefore, it was considered to spray a surface-treating agent to the exterior surface of a metal can body in order to diminish a static friction coefficient of the surface. For example, in Japanese Official Patent Provisional Publication No. showa 64-85292, it is disclosed that a surface-treating agent for a metal can, containing the undermentioned water-soluble organic substance, is applied to a metal can in order to diminish a static friction coefficient of its exterior surface and thereby to elevate mobility of the can. Said water-soluble organic substance is as follows: fatty acid derivatives such as an ethylene oxide-added stearic acid, an ethylene oxide-added isostearic acid and the like; alcohols such as an ethylene oxide-added oleyl ether and the like.

In the production process of a metal can, the transferring speed of can bodies is very fast and forementioned each treatment is usually carried out by spraying.

If a surface-treating agent foams when sprayed, disadvantage to maintenance of a production line occurs because foam overflows from a tank causing contamination or that idle running occurs when the foam reaches a supplying inlet coming from the tank to a spray nozzle. Therefore, it is desired that a surface-treating agent is hard to foam even if it is sprayed.

In addition, after treating, since drying is carried out by heating, it is necessary that a surface-treating agent has thermal stability at an operating temperature of the drying. If a surface-treating agent decomposes when the drying is carried out, an effect of diminishing a friction coefficient is damaged, so that jamming cannot be prevented.

However, the surface-treating agent disclosed in the forementioned publication has a high foaming property since it contains a water-soluble organic substance. In addition, the water-soluble organic substance has poor thermal stability and therefore it decomposes at a practical drying temperature, so that an effect of diminishing a friction coefficient is liable to decrease.

SUMMARY OF THE INVENTION

It is an object of the present invention to provide a surface-treating agent for a metal can, which has an effect of elevating smoothness of the metal can, shows a low foaming property and high thermal stability, but not uneasiness at safety, as well as to provide a concentrate for treating a metal can surface, from which the surface-treating agent is prepared.

In addition, it is an object of the present invention to provide a method for treating a metal can surface, which intends elevation of mobility of a metal can body, intends load decrease and smooth insertion of a mandrel coming in and out in coating process, is safe even in a food field, and is capable of making a transferring speed of the metal can body much faster.

To solve the above object, the present invention provides a surface-treating agent for a metal can, comprising an emulsion containing a sorbitan fatty acid ester in a concentration of 100 to 2000 mg/l in a water medium.

The present invention also provides a method for treating a metal can surface, wherein the above-mentioned surface-treating agent of the present invention is brought into contact with a metal can body in order to diminish a friction coefficient of a surface of the metal can body in the finals rage of a rinsing process which is carried out after a phosphate film is formed on the metal can body.

The present invention further provides a concentrate for treating a metal can surface, comprising an emulsion containing a sorbitan fatty acid ester in a water medium in a concentration of 1 to 10 parts by weight based on 100 parts by weight of the concentrate.

A sorbitan fatty acid ester used in the present invention is a compound shown by the below described formula (1) or (2), which may be any one of a monoester, a sesquiester, a diester and a triester, and which is preferably insoluble and dispersable in water to form an emulsion.

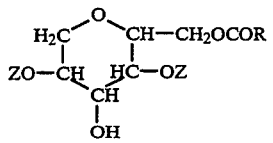

(1)

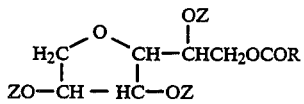

(2)

In the above formulae (1) and (2), each Z mutually independently denotes a hydrogen atom or RCO-, and each R mutually independently denotes a monovalent saturated or unsaturated hydrocarbon group of $C_{10}$ to $C_{20}$. Lauric acid of $C_{12}$ in carbon number and oleic acid of $C_{17}$ in carbon number (which has a carbon-carbon double bond) are preferably used as a material fatty acid for obtaining the sorbitan fatty acid ester. In the case that the R is a saturated hydrocarbon group, its C number is preferably 10 to 14. If the C number is less than 10, the effect of diminishing the friction coefficient may not be obtained. If the C number exceeds 14, it may become difficult to make the sorbitan fatty acid ester in existence in an emulsion condition stable in water. In the case that the R is an unsaturated hydrocarbon group, its C number is preferably 10 to 20. If the C number is less than 10, the effect of diminishing a friction coefficient may not be obtained. If the C number exceeds 20, it may become difficult to make the sorbitan fatty acid ester in existence in an emulsion condition stable in water.

A content of the sorbitan fatty acid ester in the surface-treating agent must be in a ratio of 100 to 2000 mg/l based on the surface-treating agent, preferably 200 to 1000 mg/l. If the content exceeds 2000 mg/l, outside appearance of a can after the drying being carried out is badly influenced and, in addition, if the content is less than 100 mg/l, the effect of diminishing a friction coefficient is not obtained. If the content is more than 1000 mg/l, increase of an adding amount may not lead to elevation of the effect.

A medium to disperse the sorbitan fatty acid ester is water, preferably pure water. A reason for this is that a bad influence of impurity (especially, an ionic substance) can be prevented in a process such as printing etc.

In the present invention, to maintain emulsification stability (preservation stability for a long period of time) of the concentrate and surface-treating agent, a liquid edible oil and fat may be added to them. It is preferable that an adding amount of the edible oil and fat is almost the same weight as that of the sorbitan fatty acid ester. Examples of the edible oil and fat used are general edible oils and fats such as rapeseed oil, soybean oil, coconut oil and the like.

Since a surface-treating agent of the present invention is applied to a metal can mainly used for a food vessel, it is preferable to add nothing other than water which is a dispersion medium, the sorbitan fatty acid ester, and the liquid edible oil and fat which is added to secure the emulsification stability in case of necessity. However, if necessary, a sucrose fatty acid ester such as sucrose laurate or the like can be added in a concentration range (for example, in a concentration of 500 mg/l or less) which does not influence the effects of the present invention.

Since a sorbitan fatty acid ester is not soluble in water, it is preferable that a surface-treating agent of the present invention is prepared by a method comprising: preparing a concentrate (which is an emulsion) by adding a sorbitan fatty acid ester to water beforehand in an amount higher than that in a case of the surface-treating agent and by carrying out emulsification dispersion; and then diluting the concentrate with water. The emulsification dispersion for preparing the concentrate is carried out using a apparatus such as a high speed disperser or the like. Stirring conditions to carry out the emulsification dispersion is, for example, 4000 to 6000 rpm in rotation number and 20 to 40 minutes in time. By diluting the thus-prepared concentrate with water, preferably with pure water, in the appointed concentration, the surface-treating agent of the present invention is obtained.

The surface-treating agent of the present invention is usually supplied in form of a concentrate. A concentrate like this used f or the surface-treating agent is a concentrated emulsion containing a sorbitan fatty acid ester in a water medium in a concentration of 1 to 10 parts by weight based on 100 parts by weight of the concentrate. The water is preferably pure water from a reason similar to the forementioned.

The surface-treating agent of the present invention is applied in producing a metal can such as an aluminum can or the like. The metal can is produced by a method comprising: molding a metal plate such as an aluminum plate or the like to lead it to a can body; and, with the can body successively transferred, treating it by passing through the processes in order of degreasing, first rinsing, converting, second rinsing, rinsing with pure water, and drying. Processes of from the degreasing to the second rinsing are carried out in a manner similar to a conventional method for producing a metal can. In the rinsing with pure water in the final stage, the surface-treating agent of the present invention is applied to exterior and interior surfaces of a metal can body.

A condition in applying the surface-treating agent to a metal can may be spraying treatment. The condition is usually spraying treatment at a room temperature for 5 to 20 seconds.

After the surface-treating agent of the present invention is applied, drying such as hot wind drying or the like is carried out. The drying is usually performed at a temperature of 180° to 220° C. for 1 to 3 minutes.

According to studies of the present inventors, if a friction coefficient of a metal can is diminished, such a tendency that jamming becomes hard to occur is seen and, if the static friction coefficient of a metal can is 0.5 or less, it is thought that effects are surely elevated even if a transferring speed becomes very fast. If the surface-treating agent of the present invention is applied to a metal can in a manner as mentioned above, it is possible that the static friction coefficient of the metal can be made to 0.5 or less.

A metal can body, to which the surface-treating agent of the present invention is applied, is subjected to printing, coating, or attaching of a label in a usual manner. Even if a metal can body comes into contact or collision when transferred at a high speed from the drying process to the printing or coating process, the metal can body smoothly moves and therefore, jamming or the like does not occur. This effect emerges even if the transferring speed is made to be very fast. In addition, in printing or coating, a mandrel is hard to be worn off since the mandrel is able to come in and out of the can body with small load and with smoothness.

The sorbitan fatty acid ester is superior in thermal stability since it has not an ethylene oxide structure but a cyclic structure. Because of this, even if the sorbitan fatty acid ester is subjected to heating treatment such as drying or the like after its attaching to a metal can, the effect of diminishing the friction coefficient does not deteriorate.

In addition, the sorbitan fatty acid ester is widely used as a food additive and suitably used for diminishing the friction coefficient of a metal can which is used as a vessel for food such as a refreshing drink, an alcoholic drink or the like.

The surface-treating agent of the present invention for a metal can has an effect of elevating smoothness of the metal can and shows a low foaming property and high thermal stability, but not uneasiness at safety.

The surface-treating agent is able to be easily prepared by diluting with water (preferably, pure water) the concentrate of the present invention for treating a metal can surface.

The method for treating a metal can surface of the present invention able to intend elevation of mobility of a metal can body and to intend load decrease and smooth insertion of a mandrel coming in and out in a coating process, and it is safe even in a food field and capable of making a transferring speed of the metal can body much faster.

DESCRIPTION OF THE PREFERRED EMBODIMENTS

Figure 1:
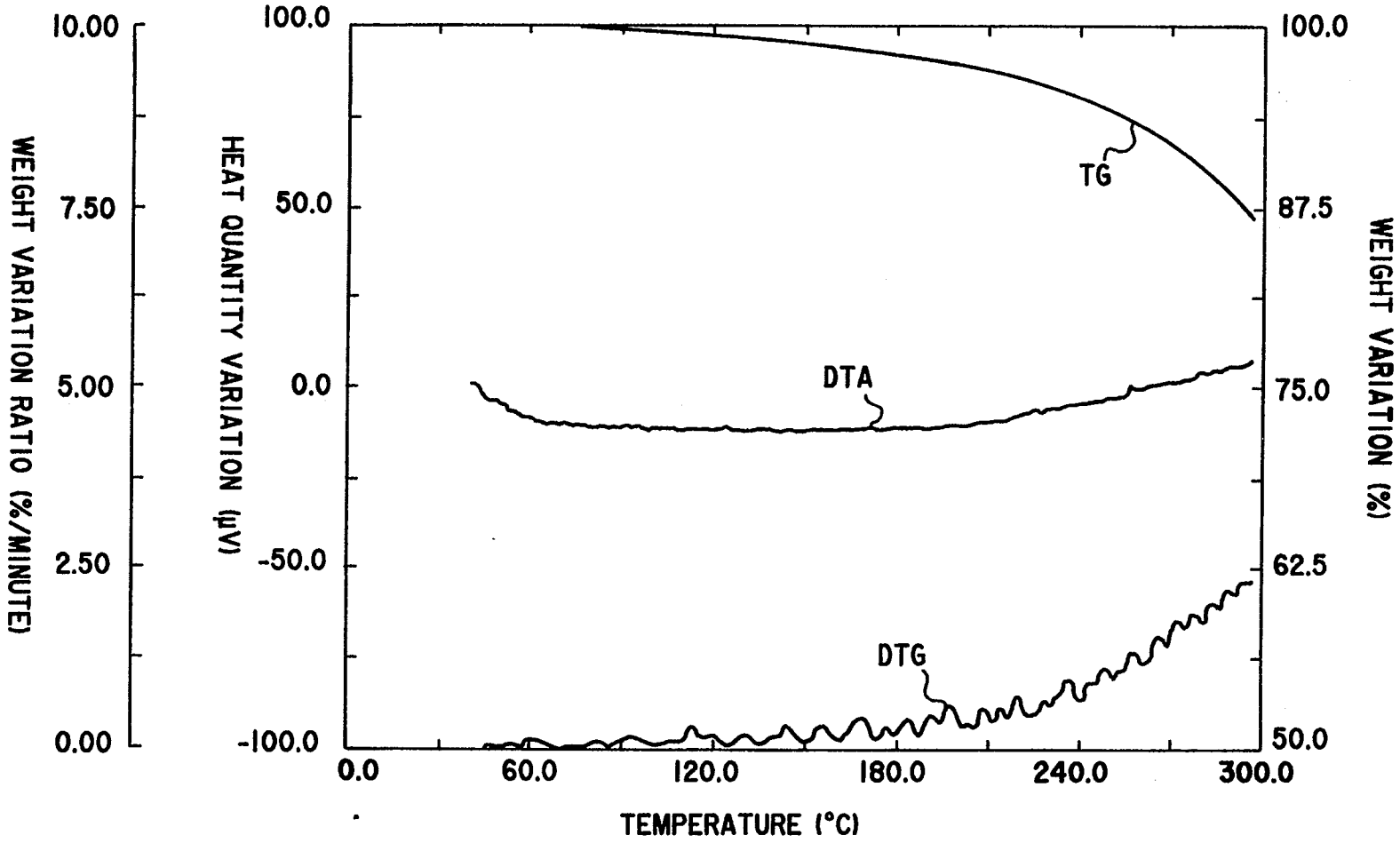
FIG. 1 is a graph showing the differential heat data of sorbitan monooleate used in EXAMPLES.

Hereinafter, concrete examples and comparative examples of the present invention are shown, but the present invention is not limited to the below-described examples.

(EXAMPLE A-1)

Sorbitan monooleate, 5 parts by weight, was added to 95 parts by weight of pure water to carry out emulsification dispersion at a room temperature with stirring at a rotation number of 5000 rpm for 30 minutes using a high speed disperser, thereby a concentrate for treating a metal can surface was obtained.

(EXAMPLE A-2)

The procedure of EXAMPLE A-1 was repeated except that sorbitan monolaurate was used instead of sorbitan monooleate, thereby a concentrate for treating a metal can surface was obtained.

(EXAMPLE A-3)

The procedure of EXAMPLE A-1 was repeated except that sorbitan trioleate was used instead of sorbitan monooleate, thereby a concentrate for treating a metal can surface was obtained.

(EXAMPLES B-1 to B-4)

The concentrate for treating a metal can surface, obtained in EXAMPLE A-1, was diluted with pure water to obtain surface-treating agents having the sorbitan fatty acid ester concentration shown in Table 1.

(EXAMPLE B-5)

The concentrate for treating a metal can surface, obtained in EXAMPLE A-2, was diluted with pure water to obtain a surface-treating agent having the sorbitan fatty acid ester concentration shown in Table 1.

(EXAMPLE B-6)

The concentrate for treating a metal can surface, obtained in EXAMPLE A-3, was diluted with pure water to obtain a surface-treating agent having the sorbitan fatty acid ester concentration shown in Table 1.

(EXAMPLE C-1)

An aluminum plate was molded to make a can body and, with the can body successively transferred, it was subjected to surface treatment by passing it through the processes in order of degreasing, first rinsing, converting, second rinsing, rinsing with pure water, and drying.

(Degreasing):

The aluminum can body was sprayed at 60° C. for 2 minutes with an alkali degreasing agent which was a 3.5% by weight aqueous solution obtained by dissolving Surf Cleaner SCL NHC-100 (an alkali degreasing concentrate, made by Nippon Paint Co., Ltd.) in water.

(First rinsing):

The can body treated with the above-mentioned greasing was sprayed with industrial water at a room temperature for 10 seconds.

(Converting):

The can body rinsed in the first rinsing was sprayed at 40° C. for 20 minutes with a phosphating agent which was obtained by dissolving ALusurf 4040 (a zirconium phosphate-based treating agent, made by Nippon Paint Co., Ltd.) in water to obtain a 2.5% by weight aqueous solution and by adjusting the solution at a pH of 3.0 with aqueous ammonia.

(Second rinsing):

The can body treated with the above-mentioned converting was sprayed with industrial water at a room temperature for 10 seconds.

(Rinsing with pure water):

The can body subjected to the second rinsing was sprayed with the surface-treating agent of EXAMPLE B-1 at a room temperature for 10 seconds.

(Drying):

The can body subjected to the rinsing with pure water was dried at 200° C. for 2 minutes.

(EXAMPLES C-2 TO C-8 AND COMPARATIVE EXAMPLES A-1 TO A-5)

The procedure of EXAMPLE C-1 was repeated to treat a surface of an aluminum can body except that the surface-treating agent for a metal can, used in the rinsing with pure water, and the drying temperature were changed as shown in Table 1. The surface-treating agent used in COMPARATIVE EXAMPLES A-1 to A-5 was an aqueous solution formed by dissolving polyoxyethylene isostearate in pure water.

(COMPARATIVE EXAMPLE B)

The procedure of EXAMPLE C-1 was repeated to treat a surface of an aluminum can body except that the rinsing with pure water was carried out using pure water instead of the surface-treating agent for a metal can.

Frictional and foaming properties of the surface-treating agents used in the process of the rinsing with pure water were examined. In addition, frictional and foaming properties in a case of pure water were also examined as a control experiment. Results obtained are shown in Table 1.

The frictional property was examined by measuring a static friction coefficient using a Heydon type friction test machine (load of 250 g and roller fixation of 100 mm/minute).

The foaming property was evaluated by height (unit: cm) of foam in a stable equilibrium obtained by that a surface-treating agent (water was used as a control) of 20° C. was continuously sprayed at a spray pressure of 1 kg/cm$^2$ using a spray tester.

TABLE 1

| | surface-treating agent for metal can | | | | | |
|---|---|---|---|---|---|---|
| | EXAMPLE No. | concentration of sorbitan fatty acid ester (mg/l) | concentration of polyoxy-ethylene isostearate (mg/l) | drying temperature (°C.) | frictional property (static friction coefficient) | foaming property (cm) |
| EXAMPLE | | | | | | |
| C-1 | B-1 | 2000 | — | 200 | 0.2 | 2 |
| C-2 | B-2 | 1000 | — | 200 | 0.2 | 3 |
| C-3 | B-3 | 500 | — | 180 | 0.2 | 3 |
| C-4 | B-3 | 500 | — | 200 | 0.2 | 3 |
| C-5 | B-3 | 500 | — | 220 | 0.2 | 3 |
| C-6 | B-4 | 200 | — | 200 | 0.3 | 2 |
| C-7 | B-5 | 500 | — | 200 | 0.3 | 2 |
| C-8 | B-6 | 500 | — | 200 | 0.2 | 3 |
| COMPARATIVE EXAMPLE | | | | | | |
| A-1 | — | — | 1000 | 200 | 0.2 | 20 |
| A-2 | — | — | 500 | 180 | 0.2 | 15 |
| A-3 | — | — | 500 | 200 | 0.2 | 15 |
| A-4 | — | — | 500 | 220 | 0.6 | 15 |
| A-5 | — | — | 200 | 200 | 0.7 | 12 |
| B | | pure water | | 200 | 0.8 | 0 |

In EXAMPLES, almost no change was seen in a range of 180° to 220° C. which is a drying temperature range in an ordinary line, and however, when in COMPARATIVE EXAMPLES the drying temperature exceeded 200° C., change occurred, and drying at 220° C. for 2 minutes obviously led to an increase of the static friction coefficient.

Figure 2:
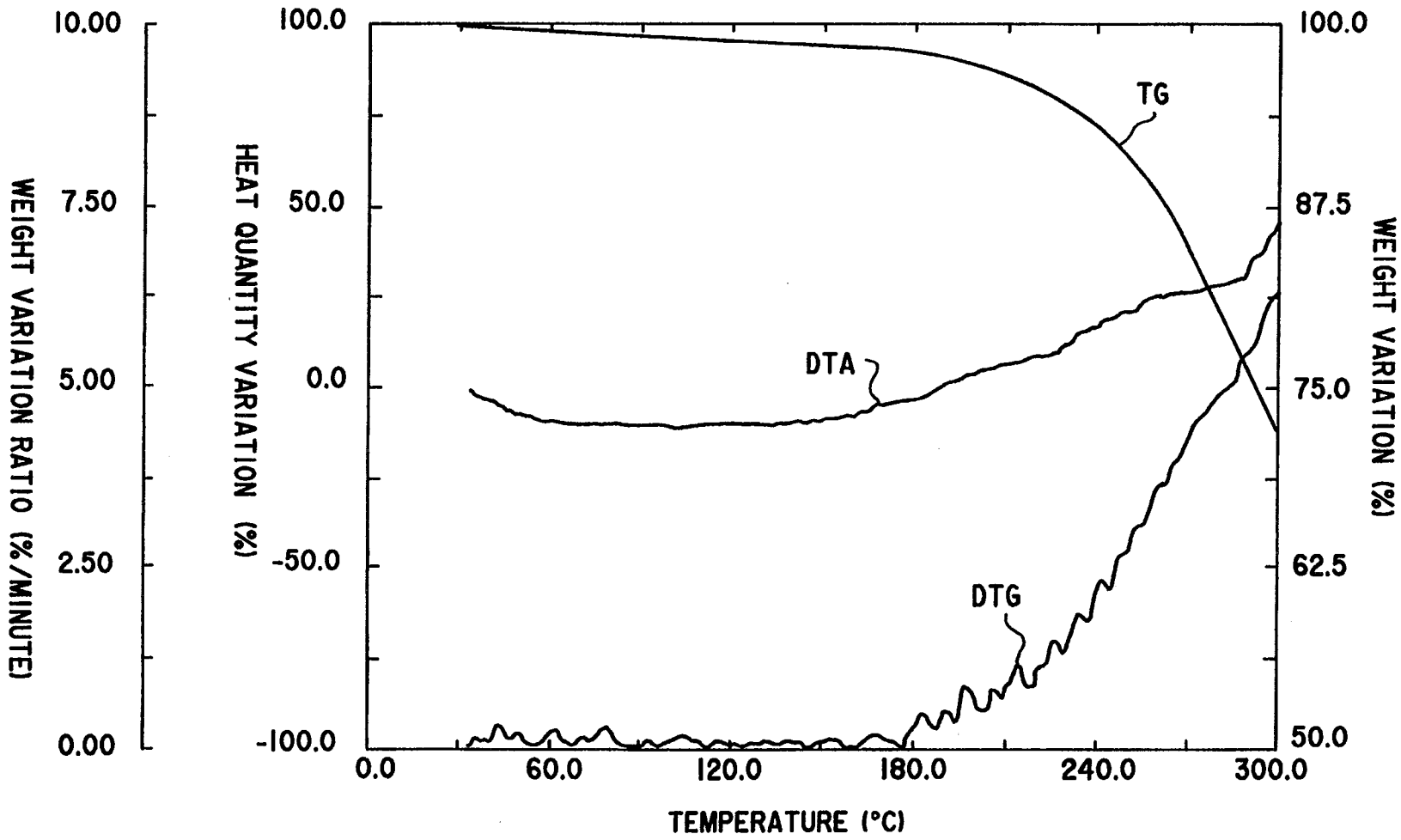
FIG. 2 is a graph showing the differential heat data of polyoxyethylene isostearate used in COMPARATIVE EXAMPLES.

It was also confirmed by the differential heat data shown in FIG. 1 (for sorbitan monooleate) and FIG. 2 (for polyoxyethylene isostearate) that the surface-treating agents of EXAMPLES were superior in thermal stability. In FIGS. 1 and 2, the curves DTG, DTA and TG denote a weight variation ratio (%/minute), heat quantity variation ($\mu$V) and weight variation (%), respectively. Measurements were carried out by elevating temperature up to the maximum of 300° C. at a temperature-raising rate of 10° C./minute using a differential thermal analyzer (I & E SSC580DS) made by Seiko Co., Ltd.

When each concentrate of EXAMPLES A-1 to A-3 and each surface-treating agent of EXAMPLES B-1 to B-6 was left in a static state of 40° C. for one week, a sorbitan fatty acid ester separated in a certain extent and floated on the surface.

(EXAMPLES A-4 TO A-6)

Each procedure of EXAMPLES A-1 to A-3 was repeated except adding a rapeseed oil in the same weight amount as that of sorbitan fatty acid ester, thereby a concentrate for treating a metal can surface was prepared.

(EXAMPLES B-7 TO B-10)

Each procedure of EXAMPLES B-1 to B-4 was repeated except using the concentrate for treating a metal can surface of EXAMPLE A-4 instead of that of EXAMPLE A-1, thereby a surface-treating agent for a metal can was obtained.

(EXAMPLE B-11)

The procedure of EXAMPLE B-5 was repeated except using the concentrate for treating a metal can surface of EXAMPLE A-5 instead of that of EXAMPLE A-2, thereby a surface-treating agent for a metal can was obtained.

(EXAMPLE B-12)

The procedure of EXAMPLE B-6 was repeated except using the concentrate for treating a metal can surface of EXAMPLE A-6 instead of that of EXAMPLE A-3, thereby a surface-treating agent for a metal can was obtained.

(EXAMPLES C-9 TO C-16)

Each procedure of EXAMPLES C-1 to C-8 was repeated, except using the surface-treating agents for a metal can of EXAMPLES B-7 to B-12 instead of those of EXAMPLES B-1 to B-6, to carry out surface treatment for the aluminum can body.

As a result, for friction and foaming properties and thermal stability, the same results as those obtained in the EXAMPLES where an edible oil and fat was not added were obtained. In addition, when each concentrate of EXAMPLES A-4 to A-6 and each surface-treating agent of EXAMPLES B-7 to B-12 was left in a static state of 40° C. for one week, no change was seen.

What is claimed are:

1. A method for treating a metal can surface, comprising the steps of forming a phosphate film on the metal can surface and applying to the metal can surface a surface-treating agent comprising an emulsion containing a sorbitan fatty acid ester in a concentration of 100 to 2000 mg/l in a water medium, in order to diminish a friction coefficient of a surface of the metal can body.

2. A method for treating a metal can surface as claimed in claim 1, wherein the surface treating agent contains an edible oil and fat in a concentration of 100 to 2000 mg/l.

3. A method for treating a metal can surface according to claim 1, wherein the surface-treating agent is brought into contact with the metal can by spraying treatment.

4. A method for treating a metal can surface according to claim 1, wherein the spraying treatment is at room temperature for 5 to 20 seconds.

5. A method for treating a metal can surface according to claim 1, further comprising the step of drying after applying the surface-treating agent.

6. A method for treating a metal can surface according to claim 5, wherein the drying is performed at a temperature of about 180° to 200° C. for 1 to 3 minutes.

7. A method for treating a metal can surface, comprising the steps of:

forming a phosphate film on the metal can surface;

rinsing the metal can surface after forming the phosphate film; and applying, after said rinsing, to the metal can surface a surface-treating agent comprising an emulsion containing a sorbitan fatty acid ester in a concentration of 100 to 2000 mg/l in a water medium, in order to diminish a friction coefficient of a surface of the metal can body.

8. A method for treating a metal can surface as claimed in claim 7, wherein the surface-treating agent contains an edible oil and fat in a concentration of 100 to 2000 mg/l.

9. A method for treating a metal can surface as claimed in claim 7, wherein the surface-treating agent is brought into contact with the metal can by spraying treatment.

10. A method for treating a metal can surface as claimed in claim 9, wherein the spraying treatment is at room temperature for 5 to 20 seconds.

11. A method for treating a metal can surface as claimed in claim 7, further comprising the step of drying after applying the surface-treating agent.

12. A method for treating a metal can surface as claimed in claim 11, wherein the drying is performed at a temperature of about 180° to 200° C. for 1 to 3 minutes.

* * * * *